US011154901B2

(12) United States Patent
Stilin

(10) Patent No.: US 11,154,901 B2
(45) Date of Patent: Oct. 26, 2021

(54) OFFSET MASKING DEVICE AND METHOD

(71) Applicant: United Technologies Corporation, Farmington, CT (US)

(72) Inventor: Nicholas D. Stilin, Higganum, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 252 days.

(21) Appl. No.: 16/027,823

(22) Filed: Jul. 5, 2018

(65) Prior Publication Data

US 2020/0009609 A1 Jan. 9, 2020

(51) Int. Cl.

| | |
|---|---|
| ***B05D 1/32*** | (2006.01) |
| ***B05D 1/12*** | (2006.01) |
| ***B05C 21/00*** | (2006.01) |
| ***B05B 12/24*** | (2018.01) |

(52) U.S. Cl.

CPC ..... *B05D 1/325* (2013.01); *B05B 12/24* (2018.02); *B05C 21/005* (2013.01); *B05D 1/12* (2013.01)

(58) Field of Classification Search

None

See application file for complete search history.

(56) References Cited

U.S. PATENT DOCUMENTS

| | | | | |
|---|---|---|---|---|
| 5,407,716 | A * | 4/1995 | Mitchell | B29C 59/007 156/267 |
| 9,790,585 | B2 | 10/2017 | Neal et al. | |
| 2009/0104356 | A1 | 4/2009 | Toppen et al. | |
| 2015/0118444 | A1 | 4/2015 | Lipkin et al. | |
| 2015/0151321 | A1 | 6/2015 | Brett | |

FOREIGN PATENT DOCUMENTS

| | | | |
|---|---|---|---|
| EP | 1760168 | A2 | 3/2007 |
| WO | WO02/068556 | A2 | 9/2002 |
| WO | WO2015/063525 | A1 | 5/2015 |

OTHER PUBLICATIONS

Extended European Search Report for EP Application No. 19184256.6, dated Nov. 4, 2019, 10 pages.

* cited by examiner

*Primary Examiner* — Jethro M. Pence
(74) *Attorney, Agent, or Firm* — Kinney & Lange, P.A.

(57) ABSTRACT

A mask includes a masking body including at least a first edge, a second edge, and a third edge, together defining at least part of a perimeter around a first surface and a second opposing surface. A standoff arrangement includes at least one projection extending from the first or second surface of the masking body. The at least one projection is connected to the first or second surface at a location inward from the at least one edge of the masking body, thereby defining a first overhanging portion of the masking body overhanging the at least one projection proximate to the at least one edge of the masking body.

11 Claims, 7 Drawing Sheets

OFFSET MASKING DEVICE AND METHOD

BACKGROUND

The disclosure relates generally to coatings, and more specifically to masking for spray coatings such that peeling is effectively eliminated upon removal of the maskant.

Traditional masking for airfoil coatings and the like utilize a mask in full and direct contact with the surface to be protected from overspray. This results in at least three related problems. First, when the full-contact mask is removed, even if done so precisely at the edge of the mask, there is no faired section to facilitate smooth fluid flow over the transition between the uncoated and coated sections. Second, removal of the maskant after the application of multiple coats may cause peeling of the coating at its periphery due to the structural cohesiveness developed by the coating and its resistance to separation as the maskant is pulled away from the application surface. Third, when scoring of the coating is performed to alleviate peeling of the coating upon removal of the maskant, any deviation away from the maskant edge may result in maskant being permanently embedded between the resulting coating and substrate which can exacerbate peeling of the coating particularly in the face of direct fluid flow against the facing edge of the coating.

SUMMARY

A mask includes a masking body including at least a first edge, a second edge, and a third edge, together defining at least part of a perimeter around a first surface and a second opposing surface. A standoff arrangement includes at least one projection extending from the first or second surface of the masking body. The at least one projection is connected to the first or second surface at a location inward from the at least one edge of the masking body, thereby defining a first overhanging portion of the masking body overhanging the at least one projection proximate to the at least one edge of the masking body.

A mask for an airfoil leading edge includes a radially outer curved masking body and a radially inner standoff arrangement. The masking body includes at least a first longitudinal edge and a second opposing longitudinal edge together defining a perimeter around a first outer surface and a second opposing inner surface. The standoff arrangement includes at least one projection extending from the second inner surface of the masking body. The at least one projection is connected to the second surface at a location inward from the at least one edge of the masking body, thereby defining a first overhanging portion of the masking body overhanging the at least one projection proximate to the at least one edge of the masking body.

An embodiment of a method includes positioning a mask over a first portion of a substrate and applying a line-of-sight coating substantially perpendicular to a second portion of the substrate adjacent to the first portion. The mask includes a masking body with at least one edge including at least a first edge, a second edge, and a third edge, together defining a perimeter around a first surface and a second opposing surface. A standoff arrangement on the mask includes at least one projection extending from the first or second surface of the masking body. The at least one projection is connected to the first or second surface at a location inward from the at least one edge of the masking body, thereby defining a first overhanging portion of the masking body overhanging the at least one projection proximate to the at least one edge of the masking body. The coating is applied adjacent to the overhang so that a full depth section of the coating is formed on the second portion and a faired section of the coating is formed under the overhang.

DETAILED DESCRIPTION

By providing an overhang on one or both edges of the mask, by way of a recessed standoff, all three of these issues can be alleviated. With a modified standoff mask, a perpendicular spray will only minimally infiltrate the space under the overhang, allowing for a faired edge to the coating to facilitate smoother fluid flow from the uncoated portion to the coated portion. This also greatly reduces the possibility of peeling even in the face of direct fluid flow against the boundary of the coating as the thickness of the coating decreases to zero at its boundary, and it is no longer necessary to estimate the edge of a full-contact mask and inadvertently create a stepped facing edge and/or leave behind masking material under the coating.

Figure 1A:
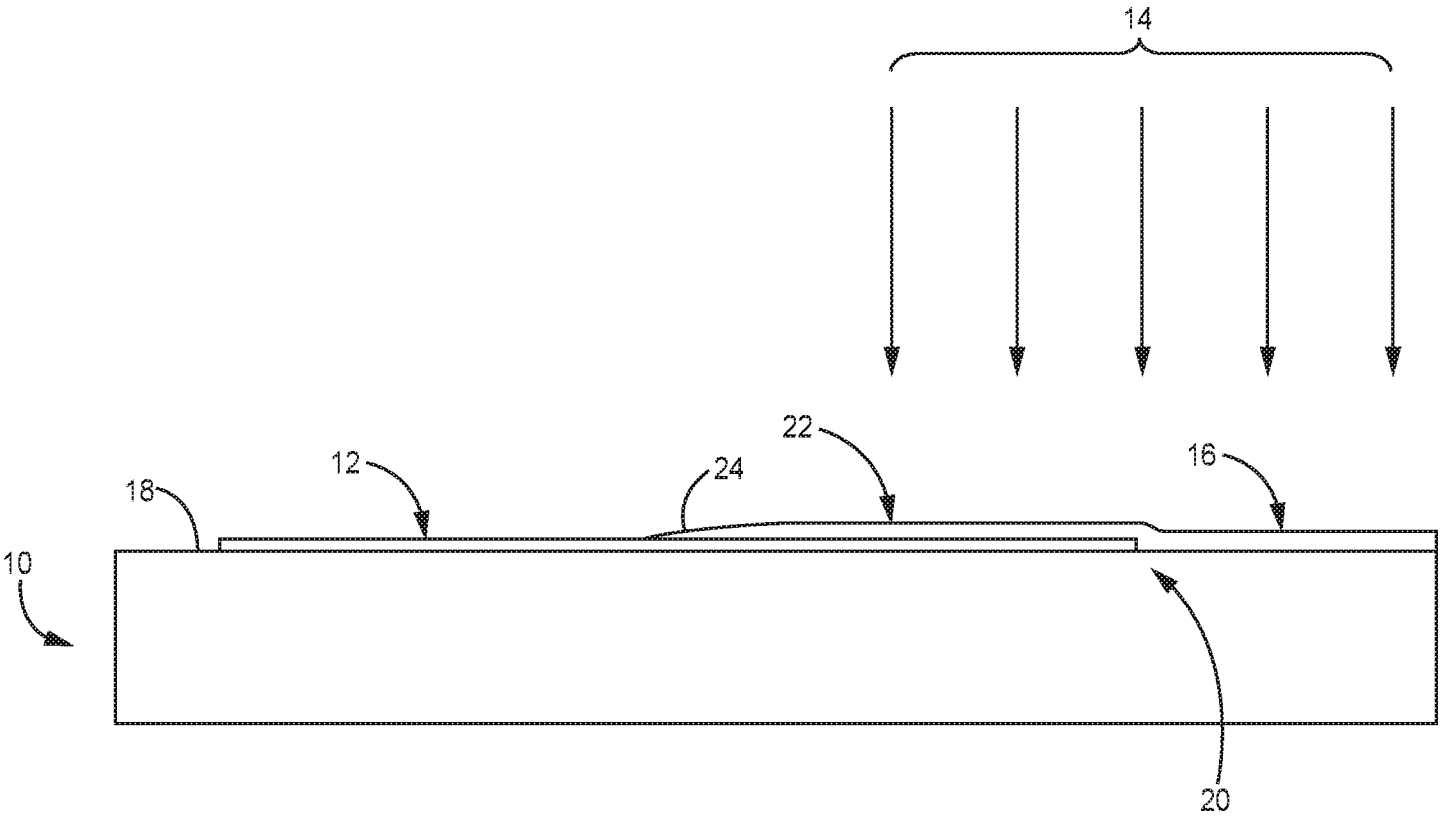
FIG. 1A (Prior Art)
FIGS. 1A-1C show a conventional mask and the accompanying issues therewith.
Figure 1B:
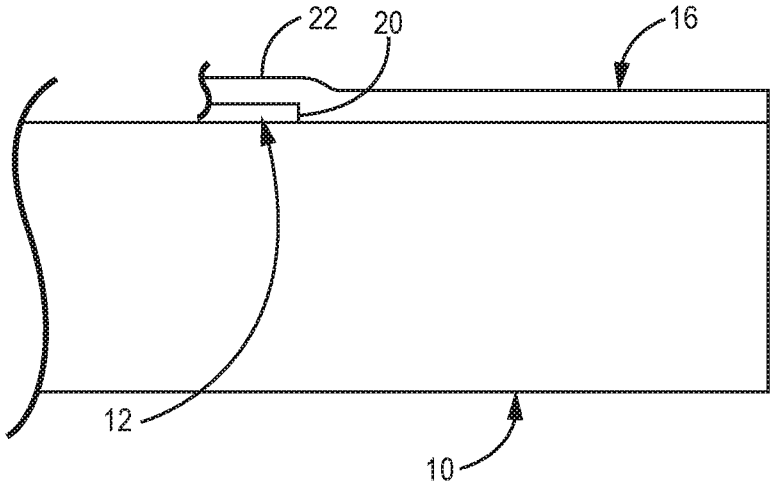
FIG. 1B (Prior Art)
Figure 1C:
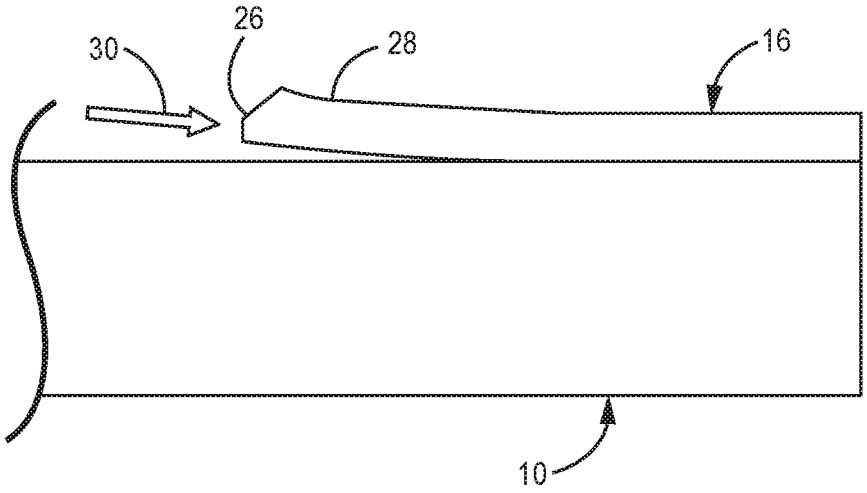
FIG. 1C (Prior Art)

FIGS. 1A-1C illustrate a result from a conventional full-contact mask used in a spray-type or other line-of-sight coating. These figures generally show one or more of substrate 10, mask 12, coating spray 14, and deposited coating 16. In FIG. 1A, full-contact mask 12 is secured, adhesively or otherwise, to the flush outer surface 18 of substrate 10 as it is exposed to coating spray 14. This results in deposited coating 16 partially overlaying edge 20 of mask 12. This is intentional, as nearly all spray and line-of-sight coatings will have some overspray 22, and which causes faired section 24 over the portion of mask 12 distal from deposited coating 16.

FIGS. 1B and 1C illustrate an example of what can happen when a full-contact mask is removed after the coating process is complete despite best efforts. Though often a full-contact mask 12 is designed to be relatively easily removed from surface 18, it is not always a clean removal. Thus in some cases, a small portion of mask 12 (e.g., edge 20) remains under the overspray area 22. In some instances, the stray portion of full-contact mask 12 is left in place, and in others (such as in FIG. 1C), a worker uses a knife to cut back the mask and overspray area 22, but which leaves a very miniscule lifted or nonadhered portion 28 of coating 16 (exaggerated for clarity). In both examples, deposited coating 16 remains susceptible to further peeling particularly as a result of oncoming fluid flows and pressures such as high-pressure air or combustion gases 30 squarely striking coating face 26 and the space underneath where coating 16 was originally adhered.

Figure 2B:
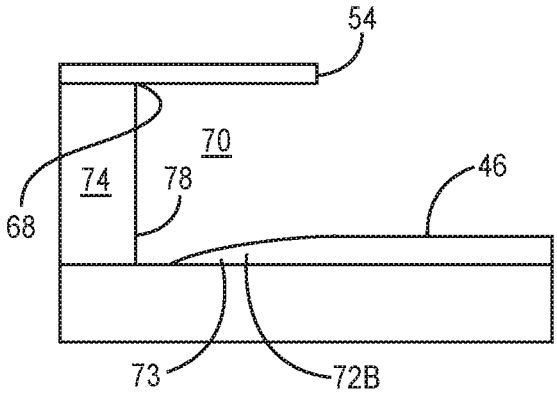
FIGS. 2A-2B show a first example embodiment of a consumable mask arrangement with standoff, overhang, and adhesive connection to the standoff material to the substrate.
Figure 2A:
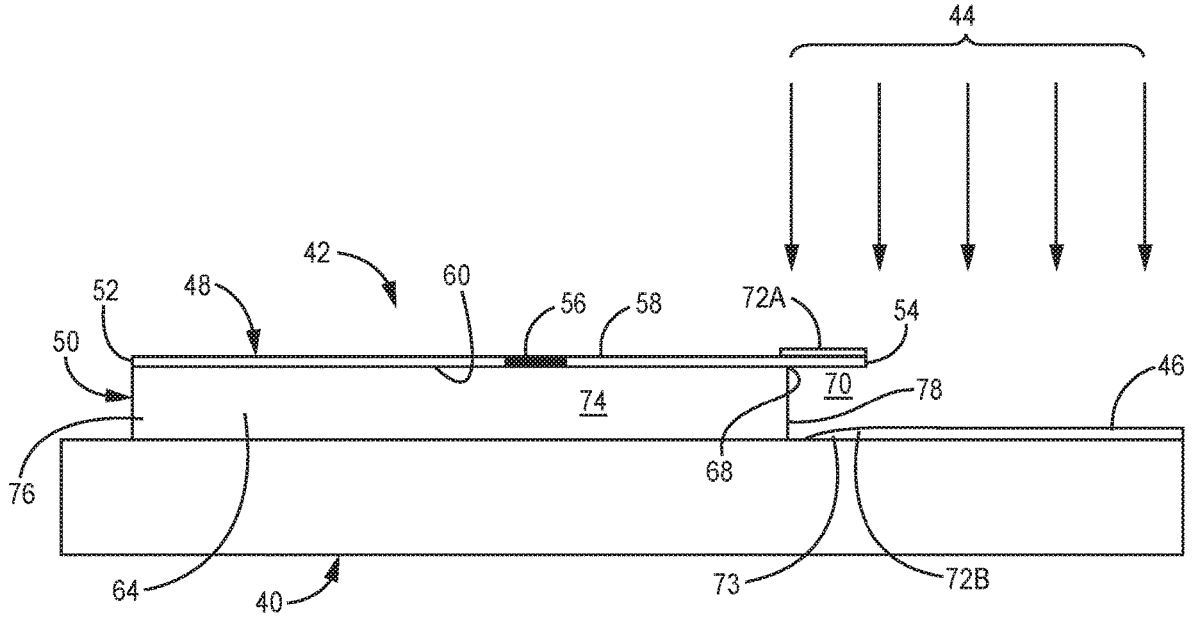

FIGS. 2A and 2B show a first example embodiment of a novel mask arrangement and generally includes substrate 40, standoff mask 42, coating spray 44, and deposited coating 46. Mask 42 includes masking body 48 and standoff arrangement 50. Masking body has at least first (longitudinal) edge 52, second (longitudinal) edge 54, and third (facing) edge 56, together defining at least part of a perimeter (not numbered) around first surface 58 and second opposing surface 60.

Standoff arrangement 50 includes at least one projection 64 extending from second surface 60 of masking body 48. Projection(s) 64 can be connected to the first or second surface (here, second surface 60) at a location 68 inward from the at least one edge of masking body 42 (here, inward from second edge 54). This defines first overhanging portion 70 of masking body overhanging projection(s) 64 proximate to second edge 54. Thus when coating spray 44 is directed along the coating path, coating 46 can be deposited as normal, with first portion 72A of overspray on second surface 58 of masking body 48 and second portion 72B of overspray on substrate 40. This also naturally results in a faired or feathered coating edge 73. This portion of the coating edge would be removed in a conventional full contact masking arrangement (see in particular FIGS. 1B and 1C).

In certain embodiments, the at least one projection 64 includes resilient layer 74 extending longitudinally between first and second standoff ends 76, 78 thereby the combination defining at least first overhang portion 70. In certain embodiments, both of the first and second standoff ends 76, 78 are offset longitudinally inwardly from the corresponding first and second longitudinal edges 52, 54 of the masking body. Thus, in addition to defining first overhang portion 70, a second opposing overhang portion (not shown) of masking body 48 can be formed.

Figure 3:
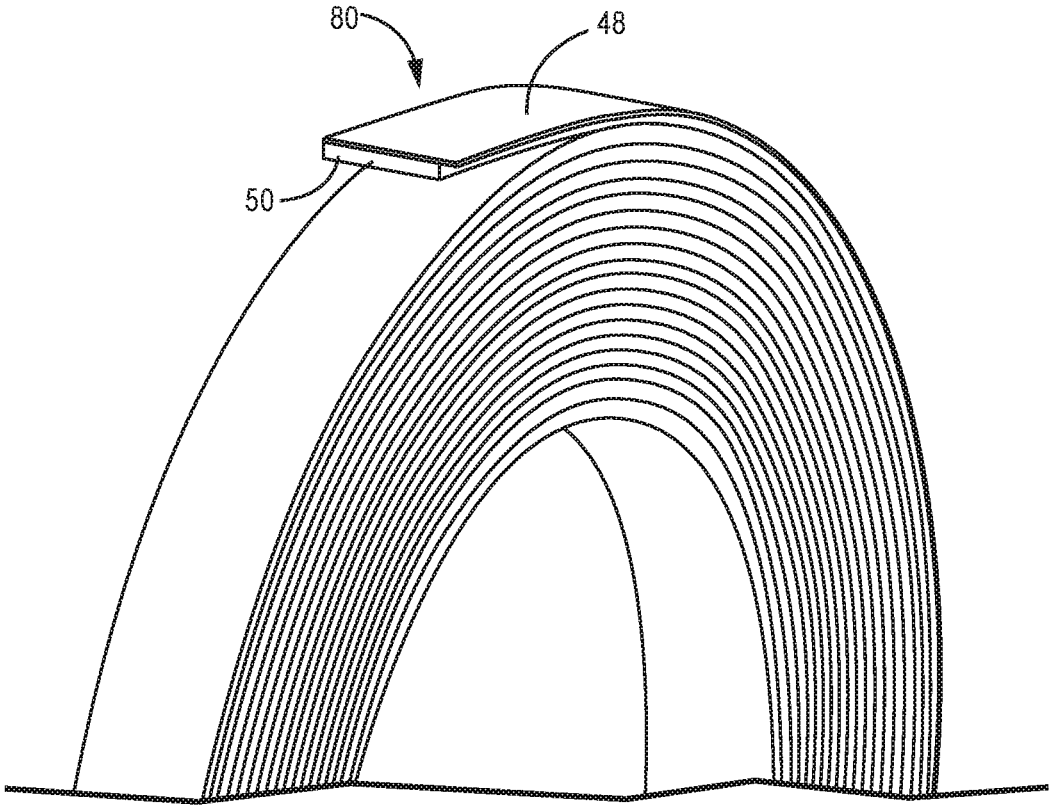
FIG. 3 shows an example package roll for storing or applying the consumable mask to the arrangement shown in FIGS. 2A-2B.

FIG. 3 shows an example packaging configuration for the above example embodiment. Here, masking body 48 can be a flexible material and resilient layer 50 includes flexible foam. This allows standoff mask 42 to be packaged into roll 80 for easy transport and dispensing for different uses. This consumable form of the stand-off makant may be appropriate for large coated areas where a durable mask may be cumbersome or where areas to be masked are highly variable such as for repairs or one-time use applications, particularly ones useful for the roll in FIG. 3).

Figure 4A:
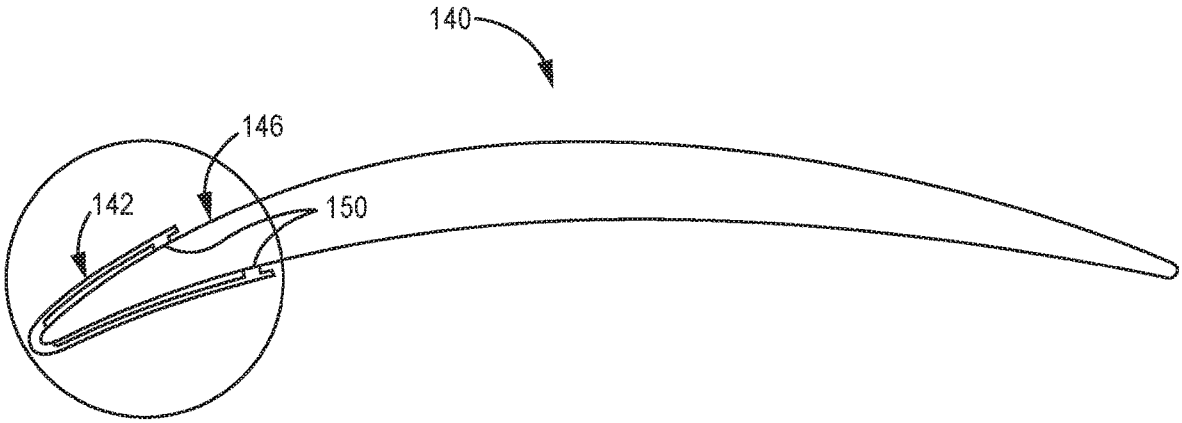
FIGS. 4A-4B show a second embodiment of a reusable mask arrangement with standoff and overhang portions relative to the substrate.
Figure 4B:
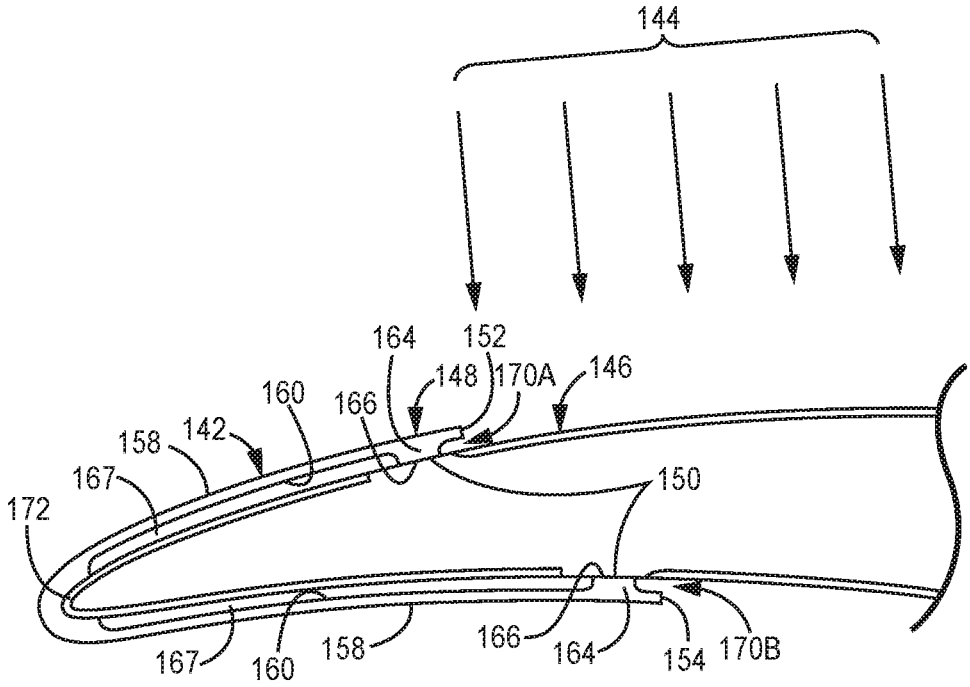

Moving to FIG. 4A and FIG. 4B, a second example mask arrangement 142 for selectively applying line-of-sight coating 144 and forming deposited coating 146. In addition to masking body 148, mask can include standoff portion 150 comprising one or more protrusions 164 with mounting surface 166 for engaging a surface of substrate 140 to be masked. In certain embodiments, such as the non-limiting example shown herein, the coating has been applied to a recess in the surface such that the resulting coated surface is tangent continuous with the uncoated surface. The small fillet of the recess is filled by the faired edge of the coating provided by diffusion of the spray due to the stand-off maskant.

Here, protrusions 164 of standoff portion 150 are each offset inward from corresponding first and second edge of masking body 148. In addition to defining inner and outer surfaces, by using protrusions in place of the arrangement in FIGS. 2A and 2B, this defines a recess 167 between the first and second protrusions 164, beneath or inward of masking body 148 when applied to substrate 140.

This arrangement is also well-suited for curved substrates where the curved portion 172 is to be protected from coating applied to aft surfaces, such as the leading edge of an airfoil in a turbine engine. Thus here, mask 142 includes radially outer curved masking body 148 including at least first longitudinal edge 152 and second longitudinal edge 154 together defining a perimeter around first outer surface 158 and second opposing inner surface 160 (in the airfoil example, corresponding to portions of suction and pressure sidewalls immediately behind the leading edge).

As noted, projections or protrusions 164 are connected to the second surface at a location inward from the corresponding first and second longitudinal edges of masking body 142. Like the first example, this defines first and second overhanging portions 170A, 170B proximate to edges 150, 152 of the masking body 142.

Coating methods according to the disclosure which can take advantage of the above described features are also provided. One such example of a method includes positioning a stand-off mask, such as is defined above, over a first portion of a substrate. Once in place, the method also includes applying a line-of-sight coating substantially perpendicular to a second portion of the substrate adjacent to the substrate, the coating adjacent to the overhang such that a full depth section of the coating is formed on the second portion and a faired section of the coating is formed under the overhang portion of the mask.

As noted, one useful example application of this method includes masking a curved portion of a substrate such as an airfoil for a turbine engine. The curved portion can include the leading edge and areas immediately aft, such as but not limited to the portions of the suction surface and pressure surface immediately aft of and adjacent to the leading edge. The second portion to be coated can be recessed into the substrate so that the first portion and the coated surface form a single substantially continuous aerodynamic surface for oncoming air or other fluid.

Though one layer is shown, often a coating process will utilize many passes to apply an even or otherwise desired coating thickness distribution in a particular coating process. This disclosure should not be read to limit any of the claims to a particular number of coating passes in a particular coating process or related coating processes.

Discussion of Possible Embodiments

The following are non-exclusive descriptions of possible embodiments of the present disclosure.

A mask includes a masking body including at least a first edge, a second edge, and a third edge, together defining at least part of a perimeter around a first surface and a second opposing surface. A standoff arrangement includes at least one projection extending from the first or second surface of the masking body. The at least one projection is connected to the first or second surface at a location inward from the at least one edge of the masking body, thereby defining a first overhanging portion of the masking body overhanging the at least one projection proximate to the at least one edge of the masking body.

The mask of the preceding paragraph can optionally include, additionally and/or alternatively, any one or more of the following features, configurations and/or additional components:

A mask according to an exemplary embodiment of this disclosure, among other possible things includes a masking body including at least a first edge, a second edge, and a third edge, together defining at least part of a perimeter around a first surface and a second opposing surface; and a standoff arrangement including at least one projection extending from the first or second surface of the masking body, the at least one projection connected to the first or second surface at a location inward from the at least one edge of the masking body, thereby defining a first overhanging portion of the masking body overhanging the at least one projection proximate to the at least one edge of the masking body.

A further embodiment of the foregoing mask, wherein the first edge of the masking body is a first longitudinal edge and a second edge is an opposing second longitudinal edge.

A further embodiment of any of the foregoing masks, wherein the at least one projection includes a resilient layer extending longitudinally between first and second standoff ends defining at least the first overhang portion of the masking body.

A further embodiment of any of the foregoing masks, wherein both of the first and second standoff ends are offset longitudinally inwardly from the corresponding first or second longitudinal edge of the masking body, defining the first overhang portion and a second opposing overhang portion of the masking body.

A further embodiment of any of the foregoing masks, wherein the masking body comprises a flexible material and the resilient layer comprises a flexible foam.

A further embodiment of any of the foregoing masks, wherein the first or second surface of the masking body is adhesively joined to a facing surface of the resilient layer.

A further embodiment of any of the foregoing masks, wherein the standoff portion comprises a first protrusion and a mounting surface for engaging a substrate to be masked.

A further embodiment of any of the foregoing masks, wherein the standoff portion further comprises a second protrusion offset inward from a second edge of the masking body, defining a recess between the first and second protrusions beneath the masking body when applied to a substrate.

A mask for an airfoil leading edge includes a radially outer curved masking body and a radially inner standoff arrangement. The masking body includes at least a first longitudinal edge and a second opposing longitudinal edge together defining a perimeter around a first outer surface and a second opposing inner surface. The standoff arrangement includes at least one projection extending from the second inner surface of the masking body. The at least one projection is connected to the second surface at a location inward from the at least one edge of the masking body, thereby defining a first overhanging portion of the masking body overhanging the at least one projection proximate to the at least one edge of the masking body.

The mask of the preceding paragraph can optionally include, additionally and/or alternatively, any one or more of the following features, configurations and/or additional components:

A mask according to an exemplary embodiment of this disclosure, among other possible things includes a radially outer curved masking body including at least a first longitudinal edge and a second opposing longitudinal edge together defining a perimeter around a first outer surface and a second opposing inner surface; and a standoff arrangement including at least one projection extending from the second inner surface of the masking body, the at least one projection connected to the second surface at a location inward from the at least one edge of the masking body, thereby defining a first overhanging portion of the masking body overhanging the at least one projection proximate to the at least one edge of the masking body.

A further embodiment of the foregoing mask, wherein the at least one projection includes a resilient layer extending longitudinally between first and second standoff ends defining at least the first overhang portion of the masking body.

A further embodiment of any of the foregoing masks, wherein both of the first and second standoff ends are offset longitudinally inwardly from the corresponding first or second longitudinal edge of the masking body, defining the first overhang portion and a second opposing overhang portion of the masking body.

A further embodiment of any of the foregoing masks, wherein the masking body comprises a flexible material and the resilient layer comprises a flexible foam.

A further embodiment of any of the foregoing masks, further comprising a first adhesive layer joining the first or second surface of the masking body to a facing surface of the resilient layer, and a second adhesive layer for joining the resilient layer to a substrate to be masked.

A further embodiment of any of the foregoing masks, wherein the inner standoff portion comprises a first protrusion at the first end.

A further embodiment of any of the foregoing masks, wherein the inner standoff portion comprises a second protrusion at the second end.

An embodiment of a method includes positioning a mask over a first portion of a substrate and applying a line-of-sight coating substantially perpendicular to a second portion of the substrate adjacent to the first portion. The mask includes a masking body with at least one edge including at least a first edge, a second edge, and a third edge, together defining a perimeter around a first surface and a second opposing surface. A standoff arrangement on the mask includes at least one projection extending from the first or second surface of the masking body. The at least one projection is connected to the first or second surface at a location inward from the at least one edge of the masking body, thereby defining a first overhanging portion of the masking body overhanging the at least one projection proximate to the at least one edge of the masking body. The coating is applied adjacent to the overhang so that a full depth section of the coating is formed on the second portion and a faired section of the coating is formed under the overhang.

The mask of the preceding paragraph can optionally include, additionally and/or alternatively, any one or more of the following features, configurations and/or additional components:

A mask according to an exemplary embodiment of this disclosure, among other possible things includes positioning a mask over a first portion of a substrate, the mask comprising: a masking body including at least a first edge, a second edge, and a third edge, together defining at least part of a perimeter around a first surface and a second opposing surface; and a standoff arrangement including at least one projection extending from the first or second surface of the masking body, the at least one projection connected to the first or second surface at a location inward from the at least one edge of the masking body, thereby defining a first overhanging portion of the masking body overhanging the at least one projection proximate to the at least one edge of the masking body; applying a line-of-sight coating substantially perpendicular to a second portion of the substrate adjacent to the first portion, such that the coating is applied adjacent to the overhang so that a full depth section of the coating is formed on the second portion and a faired section of the coating is formed under the overhang.

A further embodiment of the foregoing method, wherein the substrate comprises an airfoil for a turbine engine.

A further embodiment of any of the foregoing methods, wherein the first portion consists of the leading edge and at least one of a suction surface and a pressure surface adjacent to the leading edge.

A further embodiment of any of the foregoing methods, wherein the second portion is recessed into the substrate so that the first portion and the coated surface form a single substantially continuous aerodynamic surface for oncoming air/fluid.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A mask comprising:

a masking body including at least a first edge, a second edge, and a third edge, together defining at least part of a perimeter around a first surface and a second opposing surface;

a standoff arrangement including at least one projection extending from the first or second opposing surface of the masking body, the at least one projection connected to the first or second opposing surface at a location inward from the at least one of the first, second or third edges of the masking body, thereby defining a first overhanging portion of the masking body overhanging the at least one projection proximate to the at least one of the first, second or third edges of the masking body, wherein the at least one projection includes resilient layer extending longitudinally between first and second standoff ends defining at least the first overhanging portion of the masking body;

a first adhesive layer joining the first or second opposing surface of the masking body to a first facing surface of the resilient layer; and a second adhesive layer for joining a second opposing facing surface of the resilient layer to a surface of a substrate adjacent to a portion of the surface to be coated such that the first overhanging portion is oriented substantially parallel to and extends over the portion of the surface to be coated.

2. The mask of claim 1, wherein the first edge of the masking body is a first longitudinal edge and a second edge is an opposing second longitudinal edge.

3. The mask of claim 1, wherein both of the first and second standoff ends are offset longitudinally inwardly from the corresponding first or second longitudinal edge of the masking body, defining the first overhanging portion and a second opposing overhanging portion of the masking body.

4. The mask of claim 1, wherein the masking body comprises a flexible material and the resilient layer comprises a flexible foam.

5. The mask of claim 1, wherein the first or second opposing surface of the masking body is adhesively joined to a facing surface of the resilient layer.

6. The mask of claim 1, wherein the standoff arrangement comprises a first protrusion and a mounting surface for engaging the substrate to be coated.

7. The mask arrangement of claim 6, wherein the standoff arrangement further comprises a second protrusion offset inward from the second edge of the masking body, defining a recess between the first and second protrusions beneath the masking body when applied to the substrate.

8. A method comprising:

positioning a mask over a first portion of a substrate adjacent to a second portion of the substrate to be coated, the mask comprising:

a masking body including at least a first edge, a second edge, and a third edge, together defining at least part of a perimeter around a first surface and a second opposing surface; and a standoff arrangement including at least one projection extending from the first or second opposing surface of the masking body, the at least one projection connected to the first or second opposing surface at a location inward from the at least one of the first, second, or third edges of the masking body, thereby defining a first overhanging portion of the masking body overhanging the at least one projection proximate to the at least one of the first, second, or third edges of the masking body, wherein the at least one projection includes resilient layer extending longitudinally between first and second standoff ends defining at least the first overhanging portion of the masking body;

a first adhesive layer joining the first or second opposing surface of the masking body to a first facing surface of the resilient layer; and a second adhesive layer for joining a second opposing facing surface of the resilient layer to the first portion of the substrate such that the first overhanging portion is oriented substantially parallel to and extends over the second portion of the substrate;

adhering the second opposing facing surface of the resilient layer to the first portion of the substrate with the second adhesive layer;

applying a line-of-sight coating substantially perpendicular to the second portion of the substrate, such that the coating is applied adjacent to the first overhanging portion so that a full depth section of the coating is formed on the second portion and a faired section of the coating is formed under the overhanging portion.

9. The method of claim 8, wherein the substrate comprises an airfoil for a turbine engine.

10. The method of claim 9, wherein the first portion consists of the leading edge and at least one of a suction surface and a pressure surface adjacent to the leading edge.

11. The method of claim 9, wherein the second portion is recessed into the substrate so that the first portion and the coated surface form a single substantially continuous aerodynamic surface for oncoming air/fluid.

* * * * *